United States Patent [19]

Macchia

[11] 4,399,953

[45] Aug. 23, 1983

[54] WIRE AND CABLE PROCESS CONTROL APPARATUS

[75] Inventor: John L. Macchia, Richmond, Ky.

[73] Assignee: The Okonite Company, Ramsey, N.J.

[21] Appl. No.: 322,577

[22] Filed: Nov. 18, 1981

[51] Int. Cl.[3] ..... B65H 51/08; B65H 51/20

[52] U.S. Cl. ..... 242/47.08; 242/47.5

[58] Field of Search ..... 242/47.08, 47.09, 47.5, 242/54 R, 55, 47.01; 226/118, 119, 10, 14, 24; 66/125 T, 132

[56] References Cited

U.S. PATENT DOCUMENTS

| | | | |
|---|---|---|---|
| 2,765,904 | 10/1956 | Furness | 242/47.09 |
| 3,491,964 | 1/1970 | Warrington | 242/47.09 |
| 3,912,184 | 10/1975 | Bous | 242/47.01 |
| 4,058,265 | 11/1977 | Hedlund et al. | 242/47.01 |
| 4,186,861 | 2/1980 | Steinhilber | 226/118 |

FOREIGN PATENT DOCUMENTS

| | | | |
|---|---|---|---|
| 538927 | 4/1957 | Canada | 242/47.5 |
| 41-25249 | 5/1966 | Japan | 242/47.08 |

*Primary Examiner*—Leonard D. Christian

*Attorney, Agent, or Firm*—Hopgood, Calimafde, Kalil, Blaustein & Judlowe

[57] ABSTRACT

Cable processing control apparatus employs driven cable source and cable take up reels, or sheaves, and two variably spaced idling cable sheaves bearing multiple loops of cable as a fluctuating cable reservoir to accommodate pay off/take up reel discontinuities.

A microprocessor, cable discontinuity and reservoir sheave spacing transducers and output driver circuitry are utilized to efficiently and flexibly control the spacing between the idler sheaves as required, for example, to permit continuous cable processing when cable pay off/take up reels are replaced.

12 Claims, 2 Drawing Figures

WIRE AND CABLE PROCESS CONTROL APPARATUS

DISCLOSURE OF THE INVENTION

Figure 1:
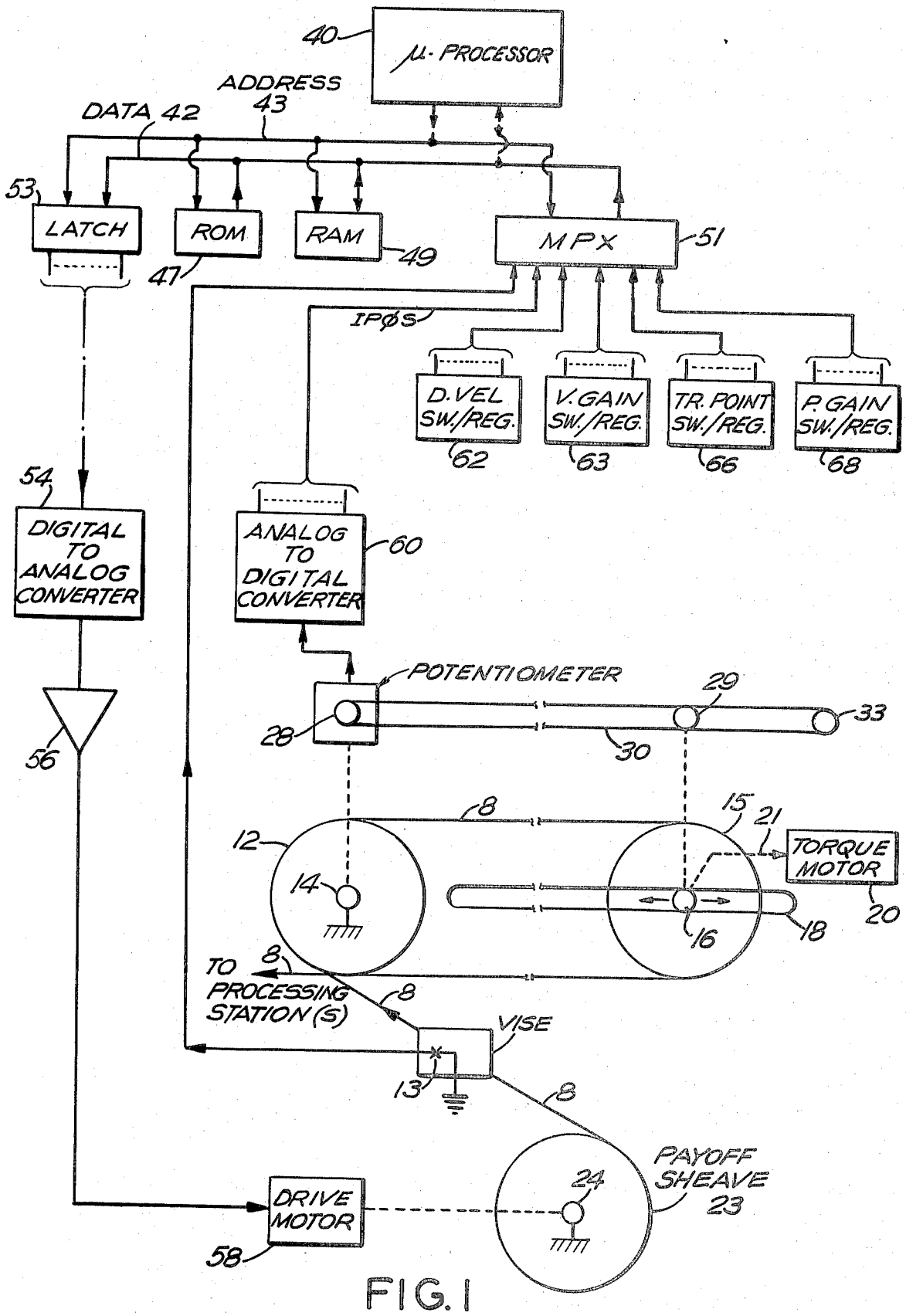

This invention relates to wire and cable processing and, more specifically, to improved process control apparatus and methodology for controlling reel or sheave dynamics—as during an active sheave substitution operation.

In wire and cable fabrication, it is common in a continuous process to pay out cable from a reel or sheave thereof to and through a processing station (e.g., a plastic or rubber jacket insulation extruder) onto a take up or output sheave. Some provision must be made to accommodate sheave replacement when the cable on the pay out sheave is exhausted (or, similarly, when the take up reel full). One method is simply to stop the production processes until cable on the next, replacement sheave can be spliced to the end of the previous cable (or until the emerging cable is cut and transferred to the next take up reel). This is usually undesirable—both from a speed of production standpoint and also by reason of many process constraints or desiderata—e.g., the requirement for continuous plastic or rubber insulation extrusion operation to assure insulation jacket thickness uniformity without core eccentricity.

One prior art approach has been to develop a reservoir of input cable stored in multiple loops of cable about two idler sheaves having a variable inter-sheave spacing. The idler sheaves move closer together to pay out cable for continuous processing when cable is unavailable from a source reel—as during reel changeover. After changeover to a new source or pay off sheave, the idler sheaves move apart toward their original spacing to replenish cable storage. Similar but inverse operation may be employed at the take up station if desired.

Such prior art apparatus has been characterized by substantial difficulties. Thus, for example, the movable idler sheave is typically very heavy on the order of hundreds of pounds. Sensing a desired quiescent, extended position for a movable sheave, as via a limit switch or other transducer, and then rapidly stopping the sheave, has been difficult—and often very wearing and destructive of the equipment involved.

It is an object of the present invention to provide improved cable processing apparatus.

More specifically, it is an object of the present invention to provide cable sheave control apparatus which flexibly, reliably and automatically accommodates substitutions in pay off/take up reels during a cable or other strand fabrication operation.

The above and other objects of the present invention are realized in a specific, illustrative cable processing control apparatus employing driven cable source and cable take up sheaves, and two variably spaced idler cable sheaves bearing multiple loops of cables as a fluctuating cable storage reservoir to accommodate pay off/take up reel discontinuities.

A microprocessor, cable discontinuity and reservoir sheave spacing transducers and output driver circuitry are utilized to efficiently and flexibly control the spacing between the idler sheaves—as required, for example, to permit continuous cable processing when cable pay off/take up reels are replaced.

Figure 2:
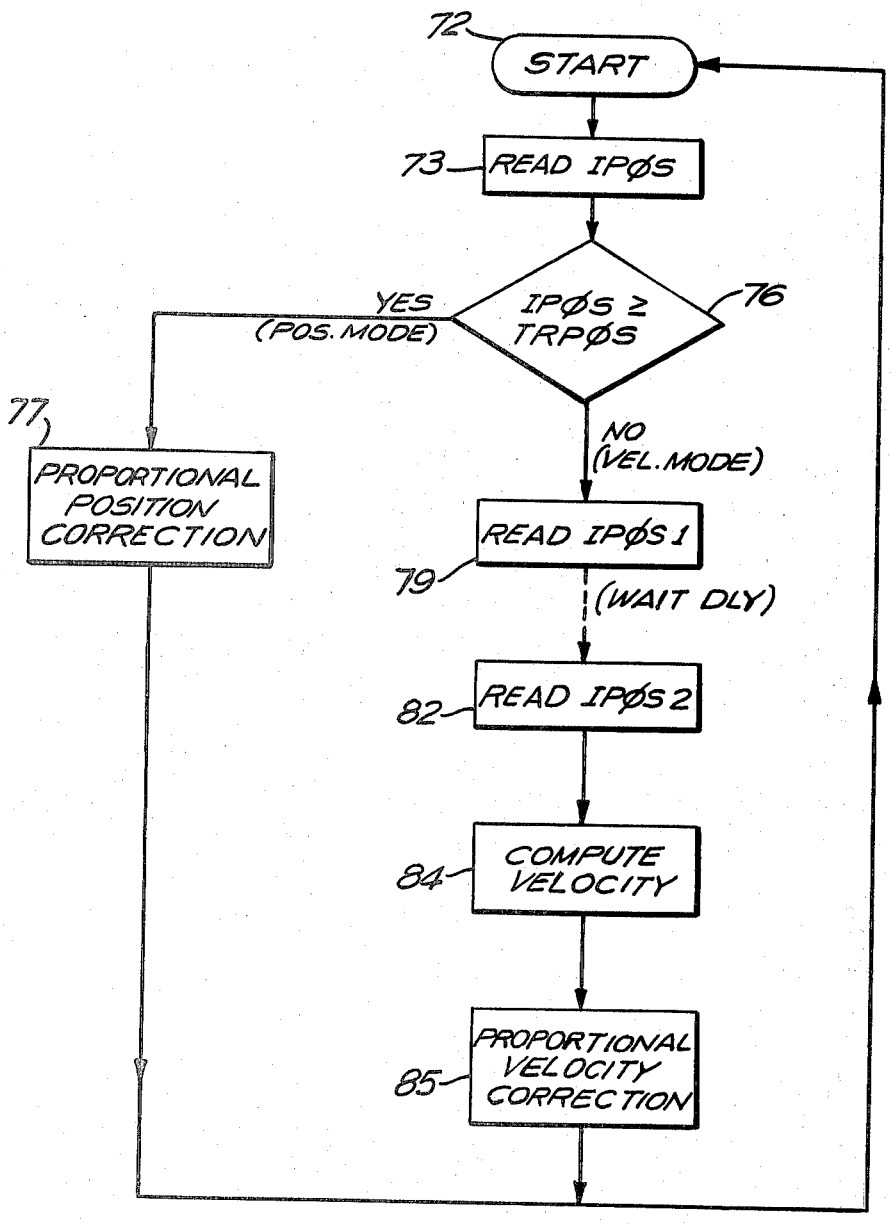

The above and other features and advantages of the present invention will become more clear from the consideration of a specific, illustrative embodiment thereof, presented hereinbelow in conjunction with the accompanying drawing, in which:

FIG. 1 is a schematic block diagram of specific, illustrative cable metering control apparatus; and FIG. 2 is a flow chart characterizing operation of a stored program controlled microprocessor 40 illustrated in the embodiment of FIG. 1.

Referring now to FIG. 1, there is shown specific, illustrative apparatus for controlling the pay out of cable for a process operation of any kind, e.g., to extrude rubber or plastic insulation about a cable center conductor or a group of center conductors 8 assumed to be initially stored on a pay off reel or sheave 23. Comparable equipment may also be employed to control the take up apparatus not shown.

As above discussed with respect to prior art apparatus, the pre-processed cable 8 contained on pay off sheave 23 passes to and about a first idler sheave 12 of a cable storage reservoir sheave couplet 12–15. In particular, cable 8 passes in multiple loops around the periphery of the sheaves 12 and 15 such that a substantial length of cable is stored thereabout. The final turn of the cable 8 about the sheaves 14 and 15 passes to the processing station, e.g., to an extruder for an assumed cable jacketing operation. As will be readily apparent to those skilled in the art, after passage through the processing station, the processed cable, e.g., the jacketed core or conductor passes to and is gathered up by a take up sheave (not shown).

The reservoir sheaves 14 and 15 have a variable spacing therebetween. This may be accomplished, for example, by having the sheave 14 freely rotate about a fixed axle 14, while the sheave 15 rotates about an axle 16 which is free to linearly translate in a mounting frame slot 18 in a direction towards or away from the sheave 12. The sheave 15 is biased in a direction away from the fixed sheave 12, as by a torque motor 20 applying tension via any mechanical coupling 21, e.g., via a belt or chain attached to a bearing on the axle 16.

A transducer, e.g., a potentiometer 28, is utilized to provide an electrical output signal identifying the instantaneous spacing between the sheaves 12 and 15. This may be accomplished, for example, by a belt 30 which translates around laterally fixed bearings 28 and 33, with a bearing 29 on movable axle 16 being connected to the belt 30 at one point. As the belt 30 moves responsive to translation of axle 16 and sheave 15, the belt 30 rotates a shaft 28 of the potentiometer, changing its electrical output. For the particular orientation and connection shown in the drawing, movement of the sheave 15 to the left will cause a clockwise rotation of potentiometer shaft 28, changing its resistance value in a first direction. Correspondingly, translation of the sheave 15 to the right will cause counter-clockwise rotation of the potentiometer shaft 28 and a corresponding opposite change in the potentiometer output. In various forms well known to those skilled in the art the resistance exhibited by the potentiometer 28 may be employed in a bridge to directly supply an electrical output signal to an analog-to-digital converter 60. Alternatively, the resistance value itself may be a sufficient electrical signal—as by inclusion directly in a lattice network; in a voltage divider; in a bridge containing in the analog-to-digital converter; or the like.

The cable 8 paid off the source sheave 23 passes through a normally disengaged vise 11 to the first reservoir idler roller 12, vise 11 having normally open contacts 13 which close to signal when the vise is in an engaged position. When cable on a particular pay off sheave 23 is exhausted, the vise 11 is engaged to retain access to the end of the cable previously contained on that specific sheave 23. The beginning end of the next or successor pay off sheave 23 (not shown) is then spliced to the prior cable length end secured in vise 11. When the splicing operation is complete, vise 11 is disengaged and cable pay off proceeds in its normal manner from the substituted pay off sheave. Multiple sheaves can be coaxially mounted on a common shaft 24. Alternatively, separate sheave mountings and drives may be utilized.

During normal operation, the pay off sheave 23 is driven by a motor 58 which is controlled by a microprocessor 40 in a manner below discussed. The cable played out from sheave 23 freely passes through quiescently unengaged vise 11; proceeds in multiple turns about the storage idler rollers 12 and 15; passes to the work station, e.g., the extruder; and is finally collected about a take up reel and take up apparatus. At the end of a pay off reel, the cable end is fixed in a vise 11 as above noted—but without impeding or stopping the cable processing operation, i.e., without stopping the extrusion. The cable pulled through the extruder under tension from the take up apparatus removes cable from the reservoir as required. That is, the cable take up progressively forces the movable idler sheave 15 to the left in the drawing such that monotonically less cable is looped about the two idler sheaves 12 and 15 as the cable 8 is consumed for processing.

When the cable splicing operation is complete such that the next pay off sheave 23 is ready for operation, the vise 11 is disengaged and the pay off sheave is rotated by the controlled driven motor 58 at a rate which exceeds that required for processing. This excess capacity is taken up by the movable sheave 15 which extends to the right, consuming the more rapid cable pay out under the urging of the force provided by the torque motor 20 through the mechanical linkage 21. After the desired storage capacity is restored to the sheaves 12–15, motor 58 again drives the pay off sheave 23 at the same rate as the take up equipment.

In accordance with one aspect of the present invention, attention is focused on the particular way in which the sheave 15 moves to the right, or increasing cable storage position. This operation is effected without any undue deceleration or other mechanical shock-producing movements to assure regular and efficient operation of the composite pay out structure shown in the drawing as well as the longevity of service of such equipment, and also good quality of cable fabrication unimpaired by shock-induced faults in the finished cable.

To this end, after the vise 11 is released when a new or replaced pay off sheave 23 has been spliced into operative connection, the cable 15 is moved at a constant velocity from its initial or closest proximity to sheave 12 until a predetermined transition point is reached. From the transition point until the sheave 15 reaches the actual or desired spacing location, sheave 15 moves towards its right or apart position in the drawing using position rather than velocity control.

The above-described control is effected by the microprocessor 40 connected via data and address buses 42 and 43 to a number of elements below discussed, including a stored program containing read only memory 47 and a read/write or RAM memory 49. The buses 42 and 43 are connected to a latch 53 to provide a digital output word corresponding to the drive speed desired for the motor 58 and the shaft 24 for the pay off sheave 23. The desired motor 58 drive speed stored in digital form in latch 53 is converted to analog by a digital-to-analog converter 54, amplified by a power amplifier 56 and applied to a control port of the drive motor 58. Accordingly, the pay off sheave 23 is directly controlled by the microprocessor 40 and rotates at the requisite speed determined by the stored contents of latch 53.

A number of input variables are communicated to the microprocessor 40 via a multiplexer 51 and the data bus 42. As above noted, an analog-to-digital converter 60 communicates to the microprocessor via multiplexer 51 and the data bus 42 the output of potentiometer 28, thereby communicating to the microprocessor the instantaneous separation between the sheaves 12 and 15. The state of the vise 11 contacts 13 is a second input to the multiplexer 51.

Finally, four registers 62, 63, 66 and 68 communicate to the microprocessor 40 via the multiplexer 51 various constants which define the motion desired for the sheave 15. The registers may comprise any standard data storing registers well known per se to those skilled in the art. One particularly useful form of such registers is a multidecade variable switch having an output binary coded decimal or other Boolean coding which identify the instantaneous setting or value for each switch decade. The switch or register 62 is loaded with the desired velocity value for movement of sheave 15 to its extended (right in the drawing) position before it reaches the transition point (computational variable DVAL discussed below). Register 63 is loaded with the computational processing value of the velocity gain desired; i.e., the rate at which error in velocity movement of the sheave is corrected (processing variable VGAIN). Register 66 is loaded with and communicates to the microprocessor 40 the spacing transition point from the velocity to the position mode above described (variable TRPØS) and, finally register 68 has a position mode error correction gain factor (PGAIN).

By reason of its importance and possible injury caused by misuse if external access were provided, a further processing variable corresponding to the desired spacing between sheaves 12 and 15, i.e., the position of movable sheave 15 within slot 18 (computational variable DPØS) is included as an integral part of the stored program. Alternatively, if a variable position is desired, a further register/switch may be employed to communicate the variable DPØS to microprocessor 40.

Functioning for the microprocessor 40 to effect the above-described mode of operation is depicted in flow chart form in FIG. 2. It is assumed that the microprocessor 40 has previously read into RAM memory 49 the variables DVAL, VGAIN, TRPØS, PGAIN and DPØS above described. This may be done on a one time basis at system initialization. Alternatively, the microprocessor 40 may periodically poll the registers 62, 63, 66 and 68 via the data and address buses 42 and 43.

Microprocessor control of the position of sheave 15 is depicted in FIG. 2 and begins with a starting point 72. As a first matter, processing reads in the instantaneous position of the sheave 15 (computational value IPØS) by issuing a command to the multiplexer on address bus 43 to correct the output of analog-to-digital converter 60 to the microprocessor 40 via the data bus 42. This, of course, communicates to the microprocessor the instantaneous output value for potentiometer 28, and thereby also the instantaneous distance or separation between the sheaves 12 and 15. A following test 76 determines whether or not the instantaneous sheave 15 position (IPØS) is greater or equal to the transition position (TRPØS). If it is ("YES" test result), meaning that the sheave 15 is to the right of the transition point in the orientation of FIG. 1, the processing operates in a position mode and follows the left branch of the test 76. If it is not, as in the period just following splicing of a new pay off sheave 23 when the sheave 12 and 15 most closely approach, a NØ results from test 76 and processing follows the sequence beneath the test 76 block in FIG. 2. Assuming a NØ result such that the equipment is in the velocity mode as just following a splice, the potentiometer 28 is again read by passing the output of analog-to-digital converter 60 to the microprocessor 40 (operation 79). The instantaneous position of the sheave 15 is stored in a variable location IPØS1. After a fixed and predetermined delay (a time DLY of fixed, constant extent, e.g., a constant one second), the potentiometer 28 setting is again examined and the contents stored in a variable location IPØS2. The instantaneous sheave 15 (IVEL) is then determined as a quotient of the movement divided by the period consumed (functional block 84), as by the programming statement:

$$IVEL=(IP\emptyset S2-IP\emptyset S1)/DLY. \quad (1)$$

It will be understood that statements such as (1) immediately above are written in schematic form and may be coded in any desired language a great many of which are known to and used by those skilled in the art. Finally, a proportional velocity correction process 85 generates an output signal (ØUTPUT) which drives the motor 58. The ØUTPUT signal is an error correcting signal and serves to drive the pay off sheave 23 in such an amount and to such an extent that any detected velocity error (VERRØR) or difference between the instantaneous velocity (IVEL) and the desired velocity (DVEL) is obviated. Many servo-mechanism like routines for correcting errors between measured and desired quantities are per se well known and may be employed, e.g., a Kalman filter. One simple but effective routine is simply to determine the error between the desired and actual velocities as by:

$$VERR\emptyset R=DVEL-IVEL; \quad (2)$$

and to update a correction variable (VCØRR) with the measured error, as by:

$$VC\emptyset RR=VC\emptyset RR+VERR\emptyset R. \quad (3)$$

Finally, the motor drive variable output ØUTPUT is set equal to the product of the correction factor and the velocity gain, as by:

$$\emptyset UTPUT=VGAIN+VC\emptyset RR \quad (4)$$

Following such processing, digital processing returns to the start point 72 to begin a next cycle of operation to assure continuous, accurate sheave 15 movement.

The above has considered the velocity mode of operation. If test 76 indicates a position mode (IPØS≧TRPØS), a proportional position correction routine 77 operates in a manner analogous to the velocity proportional correction routine 85 to act as a variable mechanism to move the instantaneous position of the sheave 15 to the desired position. This may simply involve setting a position error (PERRØR) equal to the difference between the sensed and the desired positions, as by:

$$PERR\emptyset R=DP\emptyset S-IP\emptyset S \quad (5)$$

A position correcting (PCØRR) and the output variables are then updated, as by:

$$PC\emptyset RR=PC\emptyset RR+PERR\emptyset R \quad (6)$$

and, $$\emptyset UTPUT=PGAIN+PC\emptyset RR. \quad (7)$$

Again, following position updating, control loops back to the start position to begin a next cycle of operation.

As will be apparent, the above digital processing will mantain the sheave 15 at the desired spacing position DPØS throughout normal processing and cable pay out. Moreover, the processing will restore the movable sheave 15 to its desired position to recapture lost cable following a pay off sheave replacement in the requisite velocity mode and following position mode operations in a regular, controlled, manner avoiding all mechanical shocks, system dislocations or the like. Thus, cable processing continues unabated notwithstanding pay off sheave 23 replacements, or the like.

It is observed that the vise 11 signal via vise contacts 13 selectively signals the microprocessor 40 when the vise 11 is engaged. The microprocessor 40 may periodically poll the multiplexer to determine the state of the contacts 13 as shown in FIG. 1. Alternatively, the contacts may be connected to a microprocessor interrupt port for direct and constant communication. When the contacts 13 are closed, the microprocessor 40 removes drive actuation from the motor 58 until the contacts 13 again separate. Further, it is observed that the above discussion and FIG. 1 has focused specifically on the pay off sheave 23 and a reservoir for controlling cable pay off. As described above, essentially identical structure may be employed as take up equipment either with or without the comparable equipment being used at the pay off end. That is, the apparatus functions in a manner directly comparable to that shown in the drawing, but in an inverse manner to absorb cable until a new take up reel can be connected, i.e., where the storage or reservoir sheaves extend during take up reel replacement and reduce the distance between them to resume normal spacing.

The above-described arrangement is merely illustrative of the principles of the present invention. Numerous modifications and adaptations thereof will be readily apparent to those skilled in the art without departing from the spirit and scope of the present invention.

What is claimed is:

1. In combination, a cable-bearing pay off sheave, first and second cable storing sheaves having a variable spacing therebetween, cable passing from said pay off sheave to and about said first and second cable storing sheaves, and controller means for controlling the distance between said first and second cable storing sheaves for providing cable in the absence of cable available from said pay off sheave and for restoring the separation between said first and second sheave, said controller means including digital processing means, sensor means for providing to said digital processing means a signal representative of the distance between said first and second storage sheaves, drive means for driving said pay off sheave, and means responsive to an output from said digital processing means for controlling said drive means.

2. A combination as in claim 1 wherein said controller means and digital processing means includes means for selectively separating said first and second cable storage sheaves when said sheaves are closer than a predetermined amount at a fixed velocity, and means for returning said first and second cable storage sheaves to a predetermined separation responsive to the difference between the sheave separation and said predetermined separation when said sheaves are separated more than said predetermined amount.

3. A combination as in claims 1 or 2 wherein said first sheave is rotatable around a fixed axis, and wherein said second sheave is rotatable about an axis which is movable with respect to the axis of said first sheave.

4. A combination as in claims 1, 2 or 3 wherein said sensor means includes a potentiometer, and means responsive to the distance obtaining between said first and second cable storage sheaves for varying said potentiometer.

5. A combination as in claims 1, 2 or 4 wherein said digital processing means comprises a microprocessor, plural register means for storing processing variables, and multiplexer means for selectively connecting the outputs of said plural register means and said potentiometer with said microprocessor.

6. A combination as in claims 1, 2 or 5 wherein said drive means includes a drive motor for driving said pay off sheave, and wherein said drive controlling means includes cascaded digital-to-analog converter and amplifier means connecting an output of said microprocessor with said drive motor.

7. A combination as in claim 3 or 6 wherein said first and second sheave separating means comprises means for mechanically biasing said second sheave in a direction away from said first sheave.

8. In combination, a cable-bearing terminal sheave, first and second cable storing sheaves having a variable spacing therebetween, cable passing between said terminal sheave and about said first and second cable storing sheaves, and controller means for controlling the distance between said first and second cable storing sheaves for providing or absorbing cable as appropriate when said terminal sheave ceases functioning and for restoring the separation between said first and second sheave, said controller means including digital processing means, sensor means for providing to said digital processing means a signal representative of the distance between said first and second storage sheaves, drive means for driving said terminal sheave, and means responsive to an output from said digital processing means for controlling said drive means.

9. A combination as in claim 8, wherein said first sheave is rotatable around a fixed axis, wherein said second sheave is rotatable about an axis which is movable with respect to the axis of said first sheave, and wherein said sensor means includes a potentiometer, and means responsive to the distance obtaining between said first and second cable storage sheaves for varying said potentiometer.

10. A combination as in claims 8 or 9 wherein said digital processing means comprises a microprocessor, plural register means for storing processing variables, and multiplexer means for selectively connecting the outputs of said plural register means and said potentiometer with said microprocessor.

11. A combination as in claims 8, 9 or 10 wherein said drive means includes a drive motor for driving said terminal sheave, and wherein said drive controlling means includes cascaded digital-to-analog converter and amplifier means connecting an output of said microprocessor with said drive motor.

12. A combination as in claim 9, further comprising means for mechanically biasing the spacing between said first and second cable storing sheaves.

* * * * *